US006705566B1

(12) United States Patent
Trice et al.

(10) Patent No.: US 6,705,566 B1
(45) Date of Patent: Mar. 16, 2004

(54) ACTIVE MIRROR GUIDANCE SYSTEM

(75) Inventors: James Patrick Trice, Corning, NY (US); Dale Eugene Robertson, Sunnyvale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/163,992

(22) Filed: Jun. 7, 2002

(51) Int. Cl.[7] ..... F42B 15/01; F41G 7/00

(52) U.S. Cl. ..... 244/3.16; 244/3.1; 244/3.11; 244/3.15

(58) Field of Search ..... 244/3.1, 3.15, 244/3.16–3.22, 3.11–3.14

(56) References Cited

U.S. PATENT DOCUMENTS 3,130,308 A * 4/1964 Astheimer ..... 244/3.16
4,183,482 A * 1/1980 Jozwiak ..... 244/3.16
4,277,137 A * 7/1981 Upatnieks et al. ..... 244/3.17
4,326,799 A * 4/1982 Keene et al. ..... 244/3.16
4,349,838 A * 9/1982 Daniel ..... 244/3.16
4,386,848 A * 6/1983 Clendenin et al. ..... 244/3.16
4,404,592 A * 9/1983 Pepin et al. ..... 244/3.16
5,204,784 A 4/1993 Spinhirne
5,681,009 A 10/1997 Vandersteen et al. ..... 244/3.16
6,116,537 A 9/2000 Kempas ..... 244/3.16
6,157,875 A 12/2000 Hedman et al.
6,193,381 B1 2/2001 Holler
6,198,564 B1 3/2001 Knight

* cited by examiner

*Primary Examiner*—Bernarr E. Gregory
(74) *Attorney, Agent, or Firm*—Townsend and Townsend and Crew LLP

(57) ABSTRACT

An active mirror guidance system for a vehicle is disclosed. The guidance system includes active mirrors to track a target. The mirrors are moved in response to disturbances detected by sensors or manually via remote control. The image provided from the mirrors is sent to a focus device for processing. A signature signal processing device and additional optics may also be used. A control system connects each of the components of the guidance system. The guidance system is also connected to the vehicle control equipment to steer the vehicle toward the target.

23 Claims, 2 Drawing Sheets

ACTIVE MIRROR GUIDANCE SYSTEM

STATEMENT REGARDING FEDERALLY SPONSORED RESEARCH OR DEVELOPMENT

Part of the work performed during development of this invention utilized U.S. Government funds. The U.S. Government has certain rights in this invention.

BACKGROUND OF THE INVENTION

1. Field of the Invention

The present invention relates to a guidance system. More specifically, the present invention relates to a guidance system using active mirrors to guide a vehicle.

2. Description of the Related Art

Conventional seekers employ a gimbal guidance system. Gimbal systems contain many moving parts, each of which is susceptible to failure. Due to their number of parts and complexity, gimbal systems also are weighty. Weight is typically a design constraint for airborne vehicles, which can be a difficulty for gimbal systems. Also, gimbal systems require numerous complex electrical interfaces for operation. What is needed is an improved guidance system that does not use gimbals.

SUMMARY OF THE INVENTION

It is an object of the present invention to provide an improved guidance system.

It is another object of the present invention to provide a guidance system that does not use gimbals.

It is another object of the present invention to provide a lightweight guidance system.

It is another object of the present invention to provide a reliable guidance system.

It is another object of the present invention to provide a vehicle employing an improved guidance system.

The present invention is a guidance system for a vehicle. The guidance system includes active mirrors to track a target. In a preferred embodiment, there are three mirrors. The mirrors are moved in response to disturbances detected by gyros, accelerometers, or manually via remote control. The image provided from the first and second mirrors is sent through a focus device to a third mirror. The image is then filtered and received by the image sensor for processing. A signature signal processing device and additional optics may also be used. A control system connects each of the components of the guidance system. The guidance system is also connected to the vehicle control equipment to steer the vehicle toward the target.

BRIEF DESCRIPTION OF THE DRAWINGS

The present invention is described with reference to the accompanying drawings, in which like reference characters reference like elements, and wherein.

DETAILED DESCRIPTION OF THE INVENTION

Figure 1:
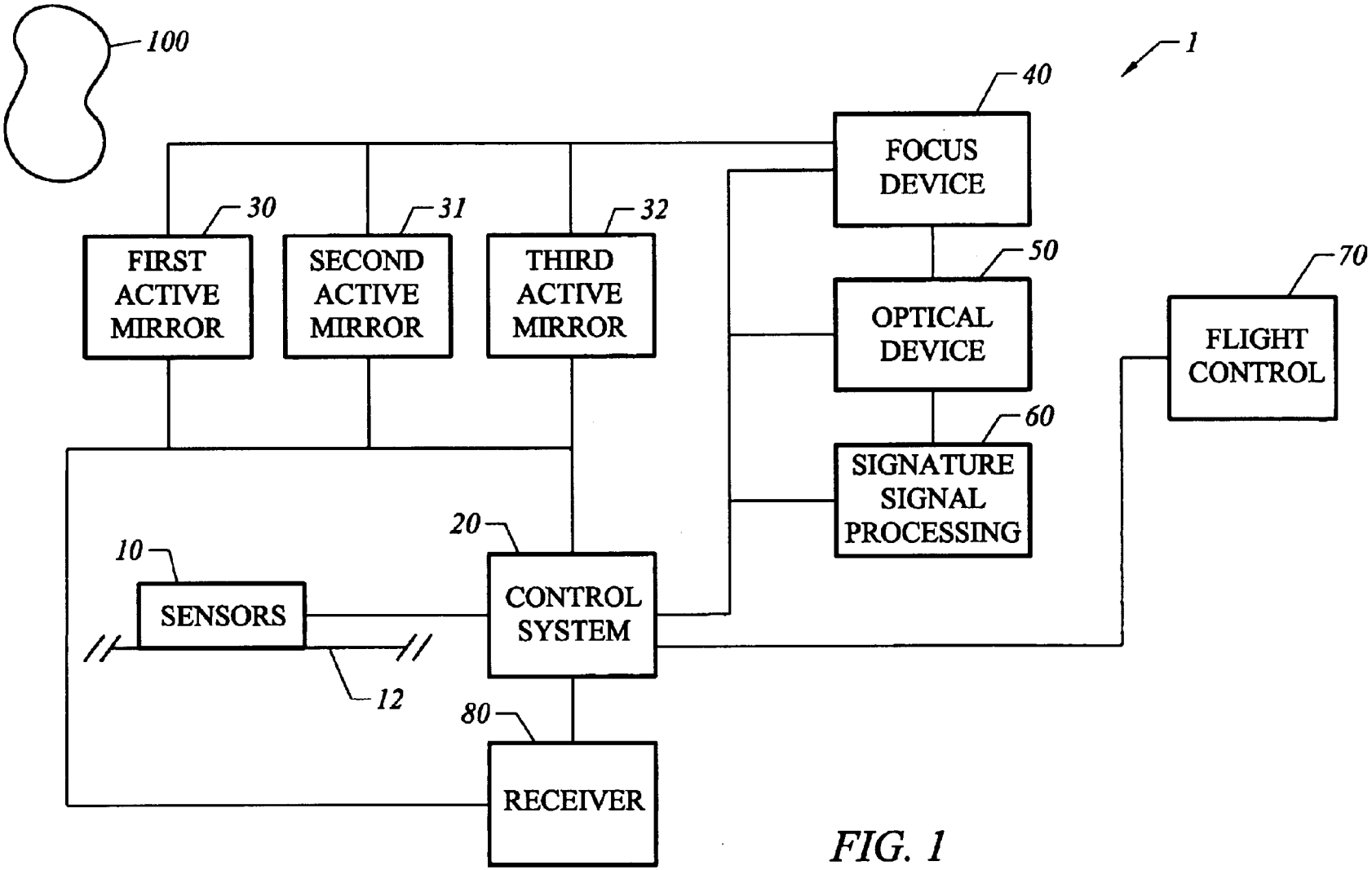
FIG. 1 shows a schematic block diagram of a guidance system of the present invention.

FIG. 1 shows a schematic block diagram of a guidance system 1 of the present invention. System 1 comprises sensors 10 to detect structural disturbances. Sensors 10 may include gyros and/or accelerometers. Preferably, sensors 10 include inertial rate gyros. Sensors 10 are coupled to a platform or casing 12 of a vehicle. Whenever platform 12 is subjected to outside forces, sensors 10 detect the disturbance and measure it.

Sensors 10 are operatively coupled to a control system 20. When sensors 10 detect and measure a disturbance, this information is transmitted to control system 20. Control system 20 may then affect other components of guidance system 1 based on the information received from sensors 10.

A first active mirror 30, a second active mirror 31, and a third active mirror 32 are operatively coupled to sensors 10 and control system 20. Mirrors 30, 31, 32 are "active mirrors" because their movement is controlled by a motor or by a magnetic system. Mirrors 30 and 31 are single rotation moveable mirrors that are used to resolve large angle slow disturbances and target direction in the pitch and yaw of the tracking system. Mirror 32 is a dual axis mirror used to resolve small, fast disturbances in the pitch and yaw of the tracking system. Mirrors 30, 31, 32 can move back and forth, tip, tilt, etc. Preferably, each mirror 30, 31, 32 is constrained to rotate about a single axis, with the axis of rotation of mirror 30 being substantially perpendicular to the axis of rotation of mirror 31. In this manner, the viewing capability of mirrors 30, 31 is maximized while minimizing the number of mirrors required. Mirrors 30, 31 are movable to maintain a line of sight on a target 100. Mirrors 30, 31, 32 are moved by control system 20 in response to information received from sensors 10. Mirrors 30, 31, 32 in conjunction with control system 20 can also determine whether and to what extent target 100 has moved. That is, guidance system 1 can be used to seek a moving target 100.

Sensors 10 may take a variety of designs. For example, sensors 10 may comprise separate sensors 10, with each mirror 30, 31, 32 being coupled to a separate sensor 10. Alternatively, sensors 10 may comprise a plurality of sensors 10 connected together, with a composite signal being sent from the plurality of sensors 10 to all mirrors 30, 31, 32. Preferably, sensors 10 comprise a plurality of sensors 10 arranged to measure disturbances about each of the three-dimensional Cartesian axes.

Information received from mirrors 30, 31 is sent to a focus device 40. A preferred focus device 40 is an infrared telescope. Focus device 40 is operatively coupled to mirrors 30, 31 to receive information measured by mirrors 30, 31. Focus device 40 focuses the image from mirrors 30, 31 onto mirror 32, which is then reflected back by an optical device 50, passed through special filters and then onto an image plane. Optical device 50 may be used with focus device 40 to process the image. Optical device 50 may also be used to bend the image around other equipment to provide a clean image at the focal plane. Optionally, guidance system 1 may comprise signature signal processing equipment 60, which may be used for a variety of purposes, including identification of target 100 and discrimination between target 100 and other objects.

All of the information received by control system 20-including information measured by sensors 10, possible movement of target 100, etc.- is fed to control system 20 where it is put into a calculation to determine jitter or other disturbances and the position of target 100. A signal is then sent from control system 20 to mirrors 30, 31, 32 to keep a line of sight on target 100. Information is also sent from control system 20 to flight control equipment 70, thereby steering the vehicle on which guidance system 1 is used to point the vehicle toward target 100.

Optionally, guidance system 1 may comprise a receiver 80. Receiver 80 can receive a signal from a remote user to control mirrors 30, 31, 32 and control system 20. In this manner, a user can use guidance system 1 to remotely control the flight of the vehicle on which guidance system 1 is used.

Figure 2:
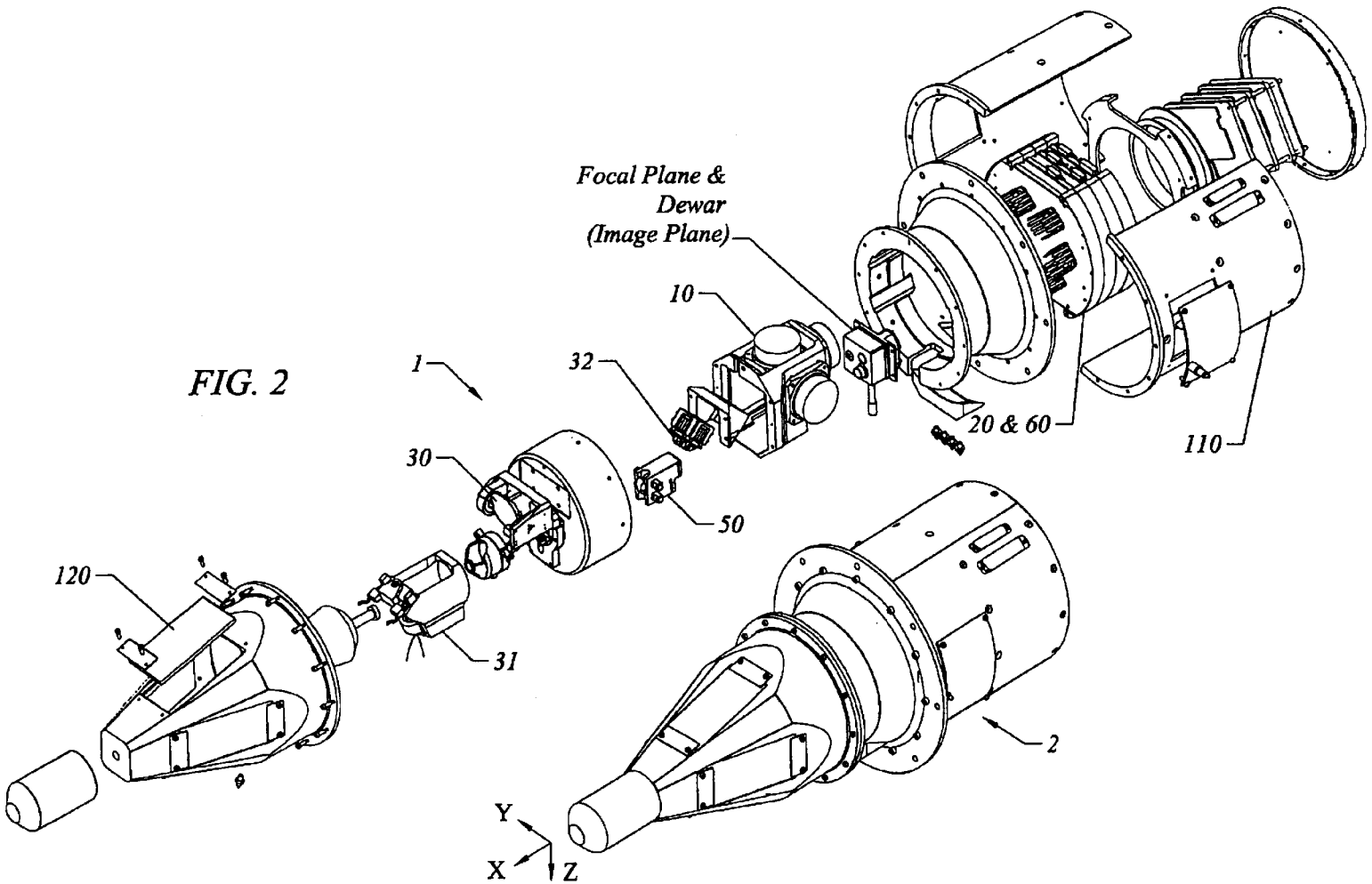
FIG. 2 shows an exploded view of a vehicle and a guidance system of the present invention.

FIG. 2 shows an exploded view of a vehicle 2 and a guidance system 1 of the present invention. Vehicle 2 can take a variety of forms. A preferred form of vehicle 2 is a missile. In prior guidance systems using gimbals, it was necessary to provide damping devices, such as shock and vibration mitigating devices, to protect the gimbals. Such damping devices are not necessary with guidance system 1 of the present invention. Rather, guidance system 1, also known as a seeker, can be coupled directly to the casing 110 of vehicle 2. Sensors 10 sense the rate of any structural disturbance. Active mirrors 30, 31, 32 are commanded to move counter to the direction of the disturbance so the overall effect is to keep the image stable on the focal plane. Image smearing and/or jitter is significantly reduced or eliminated. Guidance system 1 is designed to operate with structural disturbances as large as- 50 Gs axial acceleration, 15 Gs lateral acceleration, 4 kilometers per second forward motion, and up to 400 Hz structural vibration. Windows 120 may be provided to facilitate a line of sight between mirrors 30, 31, 32 and target 100.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A guidance system, comprising:

a first active mirror;

a second active mirror;

a third active mirror;

sensors operatively coupled to said active mirrors; and a control system operatively coupled to said sensors and said first and second active mirrors to control movement of said first and second active mirrors in response to information received from said sensors;

wherein the active mirrors are movable by actuators and are constituted without gimbals.

2. The guidance system of claim 1, further comprising a focus device operatively coupled to said active mirrors for focusing an image provided by one or a plurality of said mirrors.

3. The guidance system of claim 2, wherein said focus device is an infrared telescope.

4. The guidance system of claim 2, further comprising an optical device for processing said image, said optical device being operatively coupled to said focus device.

5. The guidance system of claim 2, further comprising signature signal processing equipment operatively coupled to said focus device for identifying a target.

6. The guidance system of claim 1, further comprising flight control equipment operatively coupled to said control system such that said control system operates said flight control equipment based on input received from the guidance system.

7. The guidance system of claim 1, wherein:

said first active mirror is rotatable about a first axis; and said second active mirror is rotatable about a second axis, said second axis being substantially perpendicular to said first axis.

8. The guidance system of claim 1, wherein said sensors include a first sensor operatively coupled to said first active mirror and a second sensor operatively coupled to said second active mirror.

9. The guidance system of claim 1, wherein said sensors include a sensor subsystem operatively coupled to both said first active mirror and said second active mirror.

10. The guidance system of claim 1, further comprising a receiver for receiving a remote control signal operatively coupled to said first active mirror and said second active mirror.

11. The guidance system of claim 1, wherein said sensors include gyros or accelerometers.

12. The guidance system of claim 11, wherein said sensors include an inertial rate gyro.

13. The guidance system of claim 1, wherein said first and second active mirrors are configured to resolve large angle, slow disturbances and target direction of the guidance system; and wherein said third active mirror is configured to resolve small, fast disturbances of the guidance system.

14. A vehicle, comprising:

a structural casing; and a seeker coupled to said casing, said casing including active mirrors, sensors operatively coupled to said active mirrors, and a control system operatively coupled to said sensors and one or more of said active mirrors to control movement of said one or more active mirrors in response to information received from said sensors;

wherein said active mirrors are movable by actuators and are constituted without gimbals.

15. The vehicle of claim 14, wherein said seeker is coupled directly to said casing without any damping devices between said seeker and said casing.

16. The vehicle of claim 14, further comprising a focus device operatively coupled to said active mirrors for focusing an image provided by one or a plurality of said active mirrors.

17. The vehicle of claim 16, further comprising an optical device for processing said image, said optical device being operatively coupled to said focus device.

18. The vehicle of claim 16, further comprising signature signal processing equipment operatively coupled to said focus device for identifying a target.

19. The vehicle of claim 14, further comprising flight control equipment operatively coupled to said control system such that said control system operates said flight control equipment based on input received from the guidance system.

20. The vehicle of claim 14, further comprising a receiver for receiving a remote control signal operatively coupled to said active mirrors.

21. A guidance system, comprising:

a first active mirror rotatable about a first axis;

a second active mirror rotatable about a second axis, said second axis being substantially perpendicular to said first axis;

a third active mirror;

sensors operatively coupled to said active mirrors; and a control system operatively coupled to said sensors and said first and second active mirrors;

wherein said active mirrors are movable by actuators.

22. A guidance system, comprising:

a first active mirror;

a second active mirror;

a third active mirror;

sensors operatively coupled to said active mirrors; and a control system operatively coupled to said sensors and said first and second active mirrors;

wherein said active mirrors are movable by actuators; and wherein said sensors include a first sensor operatively coupled to said first active mirror and a second sensor operatively coupled to said second active mirror.

23. A guidance system, comprising:

a first active mirror;

a second active mirror;

a third active mirror;

sensors operatively coupled to said active mirrors;

a control system operatively coupled to said sensors and said first and second active mirrors; and a receiver for receiving a remote control signal operatively coupled to said first active mirror and said second active mirror;

wherein said active mirrors are movable by actuators.

* * * * *